US008499494B2

(12) United States Patent
Robert, Jr.

(10) Patent No.: US 8,499,494 B2
(45) Date of Patent: Aug. 6, 2013

(54) HIGH TRAFFIC FLOW ROBOTIC ENTRANCE PORTAL FOR SECURE ACCESS

(76) Inventor: Osann Robert, Jr., Morgan Hill, CA (US)

( * ) Notice: Subject to any disclaimer, the term of this patent is extended or adjusted under 35 U.S.C. 154(b) by 820 days.

(21) Appl. No.: 12/502,997

(22) Filed: Jul. 14, 2009

(65) Prior Publication Data

US 2010/0011665 A1 Jan. 21, 2010

Related U.S. Application Data

(60) Provisional application No. 61/135,322, filed on Jul. 18, 2008.

(51) Int. Cl.
*E05D 15/58* (2006.01)

(52) U.S. Cl.
USPC ..... 49/254; 49/49; 49/68; 49/142

(58) Field of Classification Search
USPC ..... 49/49, 68, 44, 100, 104–115, 248, 49/254, 257, 258, 260, 142, 143; 109/6–8, 109/67–71; 70/DIG. 65
See application file for complete search history.

(56) References Cited

U.S. PATENT DOCUMENTS

| | | | | |
|---|---|---|---|---|
| 4,586,441 | A * | 5/1986 | Zekich | 109/8 |
| 4,741,275 | A | 5/1988 | Lewiner et al. | |
| 5,195,448 | A | 3/1993 | Sims | |
| 5,311,166 | A | 5/1994 | Frye | |
| 5,542,211 | A | 8/1996 | Colombo | |
| 5,625,176 | A * | 4/1997 | Davis et al. | 187/393 |
| 5,634,295 | A * | 6/1997 | Bunzl | 49/45 |
| 5,694,867 | A | 12/1997 | Diaz-Lopez | |
| 5,711,111 | A * | 1/1998 | Nyffenegger et al. | 49/42 |
| 5,845,692 | A | 12/1998 | Kellem et al. | |
| 6,298,603 | B1 | 10/2001 | Diaz | |
| 6,308,644 | B1 | 10/2001 | Diaz | |
| 6,484,650 | B1 | 11/2002 | Stomski | |
| 6,543,185 | B1 | 4/2003 | Borelli | |
| 6,742,301 | B1 * | 6/2004 | Schwarz | 49/42 |
| 2004/0262383 | A1 | 12/2004 | Zielinski et al. | |
| 2006/0086894 | A1 | 4/2006 | Shepherd | |
| 2006/0218863 | A1 | 10/2006 | Eshel et al. | |
| 2007/0047837 | A1 | 3/2007 | Schwab et al. | |
| 2008/0244978 | A1 | 10/2008 | Soyugenc | |

FOREIGN PATENT DOCUMENTS

| | | | |
|---|---|---|---|
| FR | 2610361 | A1 * | 8/1988 |
| JP | 63-027677 | U | 2/1988 |
| JP | 07-026836 | A | 1/1995 |
| JP | 2003-214045 | | 7/2003 |
| JP | 2004-183300 | A | 7/2004 |

* cited by examiner

*Primary Examiner* — Katherine Mitchell
*Assistant Examiner* — Catherine A Kelly

(57) ABSTRACT

Electro-mechanical and electronically controlled access devices are described for controlling access to a building, premises or area in a secure manner such that a subject who is deemed ineligible for access will be barred entry and may be optionally retained. The devices can contain multiple rotatable door panels, which can be positioned behind one another. The door panels can be controlled by mechanized arms or other control devices in order to control the passage through the device. The direction of flow through a device according to these embodiments is electronically controlled and may be changed at any point in time. At any instant in time, the flow through the device is unidirectional. Multiple devices can be stacked together to form clusters, which can be controlled according to traffic, time of day, or other factors.

21 Claims, 16 Drawing Sheets

HIGH TRAFFIC FLOW ROBOTIC ENTRANCE PORTAL FOR SECURE ACCESS

CLAIM OF PRIORITY

This patent application claims priority to U.S. Provisional Patent Application No. 61/135,322, entitled "LINEAR REVOLVING DOOR FOR SECURE ACCESS", by Robert Osann, Jr., filed on Jul. 18, 2008.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The current invention relates generally to secure entry points and access control devices that control the passage of pedestrians or vehicles in such a way as to provide a more secure access path to a building, premises, or secured area.

BACKGROUND

A wide variety of security access control devices exist today which attempt to control access to secure areas. Security checkpoints at airports include metal detection and various forms of x-ray and scanning capability, however if a person carrying a weapon was determined to pass through such a security checkpoint while knowing they would be instantly detected, they could do so, and until they were apprehended they could use their weapon within the airport. Metal detectors at the entrance to banks will warn if someone carries a gun into a bank, however it will not stop them from doing so.

Many security systems combine identification mechanisms such as cards, fingerprints, or optical scan in order to identify an individual and allow them access. Unfortunately, the perpetrator of the crime is sometimes one normally allowed access to a facility or area, and use of an identification card will not hinder them. In the case of large gatherings such as lecture halls at universities, schools in general, sporting events, and large business facilities, if a person with suicidal tendencies is determined to wreak havoc and destruction upon a large number of people, today's security access devices will not prevent them from entering if they are carrying a weapon and intend to use it.

Therefore, a new security access control device is needed that will not only detect a person carrying a weapon and attempting to pass through an access point, but will absolutely prevent that person from passing if a decision is made to prevent them—that decision often being made automatically. Also, and given the fact that many of the institutions mentioned above normally allow unhindered access into areas where large gatherings occur, it is important that any new security access device allow high traffic flow at peak times while still being capable of stopping a person carrying a weapon.

A form of access mechanism still popular today is that of a revolving door. It provides continuous flow in both directions, and in spite of the fact that entry into a revolving door can be a little intimidating for some people, revolving doors are deemed to be safe, people understand how to use them, and they continue to be designed into new buildings including hotels, banks and airports. As a side benefit, a revolving door minimizes energy loss due to the manner in which air passes through the door.

There are negatives relative to using a conventional revolving door in a security application, and especially in applications where the amount of traffic is substantial. Conventional revolving doors provide a fixed amount of traffic flow, and the level of flow is always equal in both directions. Thus at a time of day when most people will be exiting a facility, a revolving door will have one half of its capacity unutilized, and therefore a conventional revolving door is space-inefficient. In other words, given an entry passageway to a facility or area of a certain width, a conventional revolving door would be wasting half of that width at times of peak flow in primarily one direction.

If a person in a revolving door was detected to be suspect of carrying a weapon, the revolving door would be stopped and possibly reversed, however if another person was simultaneously exiting in the opposite direction within the same revolving door, they would be stuck in the door, or forced to back up.

Full height turnstiles with multiple crossbars can be useful but have similar problems. Only half the width of a conventional turnstile unit is used for passage and the other half is not usable because of the style of construction of these units. Also, because a conventional turnstile is stationary, placing two of them in series in order to stop a detected perpetrator between them creates the requirement for both of them to be closed at the same time, and also that they both should never be open simultaneously. As a result, a person cannot enter such a turnstile complex while the person ahead of them is simultaneously leaving. Thus the use of a conventional turnstile tends to impede the flow of traffic and is space-inefficient in a manner similar to a revolving door.

What is needed is a security access control device that is space efficient, extremely high throughput, and offers great flexibility in directional control, while at the same time will absolutely prevent a person carrying a weapon from entering a secured area. Applicant has identified these, as well as other shortcomings and needs in the current state of the art in coming to conceive the subject matter described and claimed throughout in this patent application.

SUMMARY OF THE INVENTION

The embodiments of the invention described herein are electromechanical and electronically controlled access devices for controlling access to a building, premises or area in a secure manner such that a person who is deemed ineligible for access will be barred entry and may be optionally retained. One or more access control devices according to this invention would be deployed such that only way to enter a secured area would be through an access control device. A subject wishing to enter a secured area protected by such devices would find the spaces adjacent to and above the access control device sealed allowing the only route of passage to be through an access control device. The direction of flow through a device according to these embodiments is electronically controlled and may be changed at any point in time. At any instant in time, the flow through the device is unidirectional. The terms "access control device" and "security portal" and "portal" are herein used synonymously.

One object of the various embodiments of this invention is to provide a security access control device that is space (width) efficient while offering extremely high throughput, such that subjects attempting to walk through the security access control device may do so while walking continuously through the security access control device. The security access control device should be suitable for operation at the entrance to different forms of facilities where people may gather, including the following:

Airport main entrances
Train and Bus stations
Hotels
Banks
Churches, Synagogues, and Mosques
Marketplaces and Malls
Stadiums and conference halls
Government and office buildings
Factories
High schools, colleges, and universities One object of the various embodiments is that multiple access control devices such as those described herein may be stacked side by side to allow further increased traffic flow, and that the width is as small as possible to allow a large number of such access devices to be stacked side-by-side thereby further increasing traffic flow when the space available for such access devices is limited. When multiple access control devices are used, the number of devices allowing flow in one direction relative to the opposite direction may be varied according to time of day and according to demand. For instance if used at the entrance to a building at a time when individuals are expected to be mostly entering the secure area, the majority of the access controlling devices would be controlled to allow flow in the direction consistent with entering. Control of which portals within a stack or gang are in "enter" mode and which are in "exit" mode may be optionally performed automatically by a central control system that controls multiple portals. Such a central control system may make decisions on the directional flow of individual portals within a gang based on information describing the aggregate directional flow of a crowd of subjects as determined by sensor(s) that observe the areas on the exit and entrance sides of a stack or gang of multiple portals. Such sensor(s) may use visual, sonic, IR, or RF imaging to observe aggregate traffic flow to determine the overall magnitude of flow and the aggregate magnitudes of flow in each of entrance and exit directions. As part of this control, a particular portal may need to change direction from time to time. When a portal is about to change direction, a message can be displayed on that particular portal that in a specific time period, it will change direction and cease to allow passage for those currently in line should a queue exist. Such a message can also count down the tine remaining so that individuals who will need to move to a different portal are properly and fairly notified in plenty of time to make the move. Upon an emergency such as a fire or earthquake, all devices could be set to a mode consistent with exiting the secured premises. Alternately, the device is capable of being electronically controlled to be placed in a mode where all doors contained therein are fully open and individuals have unimpeded capability to exit a premises in the emergency.

In various embodiments, a variety of sensor technologies may be incorporated into the device, such that as an individual is entering and is subsequently contained within the doors of the device, the individual and their belongings are scrutinized to determine if a weapon is present. Such technologies may include but are not limited to metal detectors, chemical, explosive, biological, and radiological sensors, and different scanning technologies including x-ray imaging and penetrating RF imaging such as (UWB) radar imaging or millimeter wave imaging. Such sensors and associated sensor-related components may be incorporated into any components of the structure comprising the linear revolving door mechanism, including the side walls, floor, ceiling, and any surfaces of the moving door panels. Video imaging may also be included such that a subject's face may be observed as they walk through the access control device. Observing and analyzing the expressions on a subject's face have been shown to offer clues as to a subject's state of mind—especially when they are contemplating a violent act and/or self-destruction.

Another object of the various embodiments is that each door panel should move automatically without requiring or allowing any contact with subjects passing through the access control device, and by sensing the proximity and movement of subjects passing through, will automatically adjust the rate of movement of the different door panels within the access control device to match the speed of movement of a subject, thus maximizing the throughput rate of the access control device by adapting to the rate of movement of each subject passing through. In order to do this, door panels are driven by electromechanical means controlled by a computer/processor. In addition, proximity sensors in the door panels and/or the side panels sense the location of individuals approaching the access control device and passing through it, and the rate of movement and position of the door panels is controlled such that panels never touch individuals passing through. The movement of the door panels can be controlled to track the pace of the subject walking through and match their pace to allow maximum throughput, as long as there is still enough time while both door panels are "closed" to form a detection chamber and take a reading of included threat sensors. Various types of proximity sensors are known in the art and may be used including sound, IR, and RF based sensors. Additionally, emitters and receivers for position and/or proximity sensing may be placed in the top cover and/or the floor of the portal.

Another object of the various embodiments is that weapon passing from one perpetrator to another through the access control device is not possible. To fulfill this objective, any gaps that exist between a door panel and a side panel at any point during the motion of that door panel may be optionally filled by additional sliding panels which move adjacent to a side panel in the vicinity of a door panel and are electromechanically controlled such that any gap that may emerge is filled, these additional sliding "filler panels" being controlled such that their motion does not interfere with the movement of any door panel. Alternately, each of the moving door panels may contain a telescopic extension that extends to fill the gap between that panel and a side panel of the access control device. To further prevent passing of weapons through the portal, and also to enable temporary sealing of a "detection chamber" that is briefly formed when the moving door panels of a portal are parallel, additional gap filling and sealing embodiments are included between the moving door panels and the top cover of the portal to temporarily block air movement in and out of the "detection chamber" and also to prevent the passing of weapons through the portal.

Another object of the various embodiments is that it be constructed with door panels and side panels fabricated from bulletproof material such that a perpetrator who becomes trapped within the device cannot shoot their way out, or if they are carrying an explosive device, the blast will be at least partially contained if the explosive device is activated from within the access control device. A clear bulletproof material such as polycarbonate may be suitable, as well as certain composite materials such as Kevlar.

Another object of the various embodiments is to provide a provision for disabled individuals in wheelchairs to pass through. In order to do this it may be appropriate to utilize a security verification mechanism such as a card reader, fingerprint reader, or retina scan mechanism used in conjunction with the access control device—such security verification mechanisms authenticating that the individual is in fact disabled and has the right to pass through the access control device in a wheelchair.

Another object of the various embodiments is to allow a parent with child to pass together through the security access control device. A similar capability will allow a second person to accompany a disabled person through the portal. If that person is a guard carrying a weapon, a biometric device can be available to allow the guard to be properly identified and allowed to pass through along with a disabled person or child that has also been properly identified. Sensors in the portal can validate that only the persons being biometrically identified are in the portal.

Another object of the various embodiments is that the access control device can be optionally programmed so that when an alarm is set off, the door panel behind the individual opens thereby allowing the person to exit in the reverse direction. To avoid false alarms when large numbers of individuals are passing through the security access control devices during peak traffic times, the access control device may be used in conjunction with a pre-chamber where individuals who believe they might set off an alarm, possibly due to equipment they are carrying or embedded metallic medical devices in their body, can determine if they will pass successfully before attempting to pass through the access device whereby they gain entry to the building, premises, or secured area. Objects that set off the alarm can be separately screened in a security screening conveyer similar to those found at airports.

Another object of the various embodiments is that the access control device may be used in conjunction with a crowd motion sensing means, such that the directionality of individual devices within a cluster of access control devices according to this invention may be controlled from moment to moment in such a way as to match directional throughput capability of the cluster with the requirements indicated by crowd movement.

Another object of the various embodiments is that the access control device is capable of operating unattended for extended periods of time. A stack or gang of access control devices according to this invention may also operate unattended, or alternately may require only minimal attendance, for instance a single security guard who presides over a stack or gang of multiple access control devices.

Another object of the various embodiments is that the access control device may include ducting for controlled air flow such that air in the vicinity of the subject entering and within the device may be moved and passed through sensor devices which may detect chemical, biological, and/or radiological hazards.

Another object of the various embodiments is that the access control device may include ducting for controlled air flow such that air moving from within a building into the access control device is at least partially re-circulated back into the building rather than released to the outdoors, in order to conserve energy.

DETAILED DESCRIPTION

The invention is illustrated by way of example and not by way of limitation in the figures of the accompanying drawings in which like references indicate similar elements. References to embodiments in this disclosure are not necessarily to the same embodiment, and such references mean at least one. While specific implementations are discussed, it is understood that this is done for illustrative purposes only. A person skilled in the relevant art will recognize that other components and configurations may be used without departing from the scope and spirit of the invention.

In the following description, numerous specific details are set forth to provide a thorough description of the invention. However, it will be apparent to those skilled in the art that the invention may be practiced without these specific details. In other instances, well-known features have not been described in detail so as not to obscure the invention.

In accordance with the embodiments of the invention, there are described devices and methods for controlling secure passage between two or more locations. Each of these devices can contain multiple rotatable door panels that can be positioned behind one another. In various embodiments, the door panels can be controlled by mechanized arms or other control devices in order to perform the functionality described herein.

Figure 1:
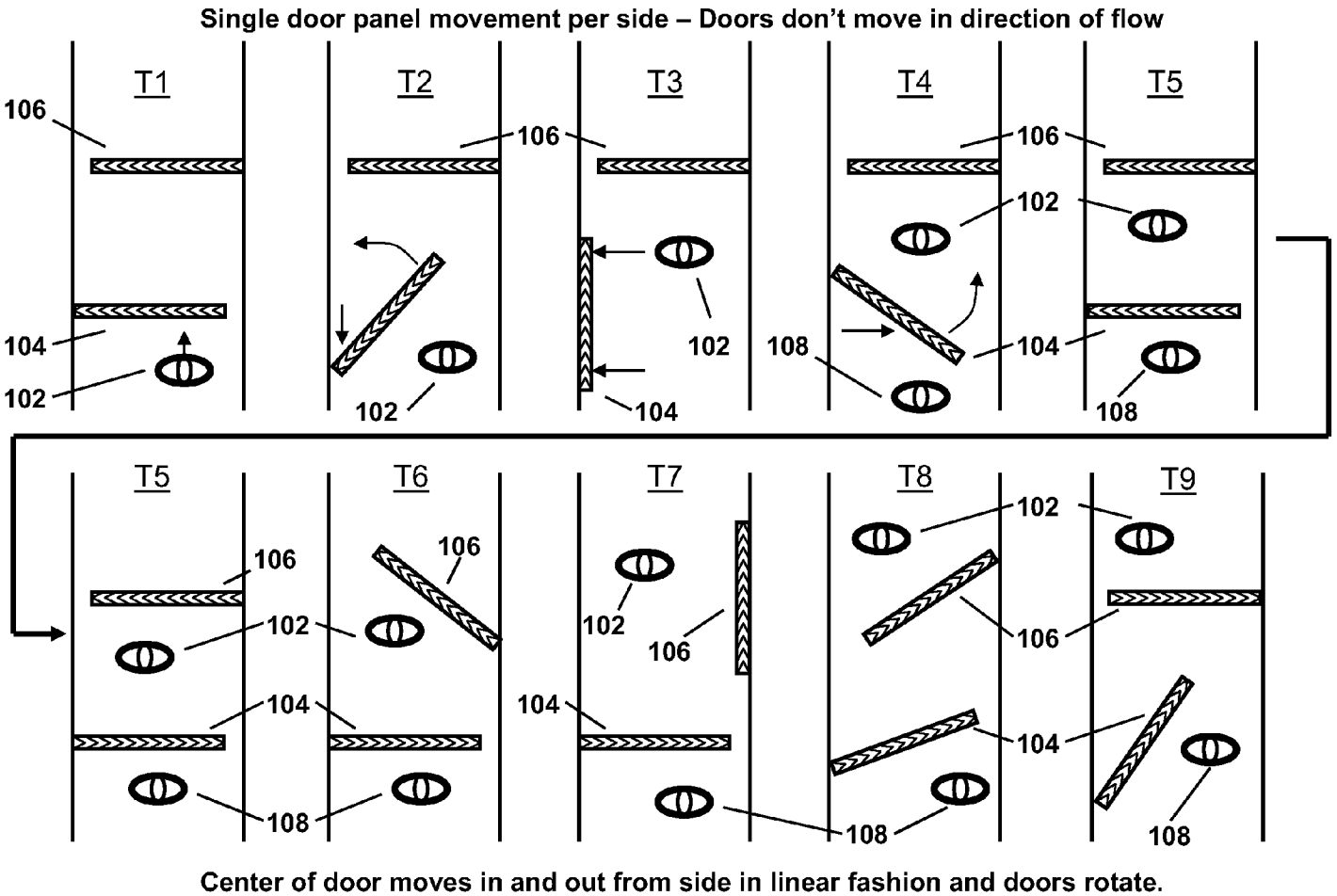
FIG. 1 is an illustration of a security access control device, in accordance with various embodiments of the invention.

FIG. 1 is an illustration of a security access control device, in accordance with various embodiments of the invention. Although this diagram depicts components as logically separate, such depiction is merely for illustrative purposes. It will be apparent to those skilled in the art that the components portrayed in this figure, or in any other figure of this specification, can be combined, or divided into separate parts. Furthermore, it will also be apparent to those skilled in the art that such components, regardless of how they are combined or divided, can be distributed among multiple devices and can function in conjunction with one another.

According to the embodiment illustrated in FIG. 1, there are two door panels within the device, each capable of controlled rotation and lateral movement perpendicular to the direction of flow. The sequence begins with timeframe T1 where a subject 102 is about to enter the access control device. In T2, door 1 104 rotates and moves laterally and by T3 the subject 102 has entered the device. In T4, door 1 104 now rotates and moves laterally in a motion emulating a revolving door, eventually closing behind the subject 102 in timeframe T5. In T5 the chamber within the access control device is essentially sealed, thus forming a detection chamber, and sensors will determine the presence of any weapons and whether or not the individual will be allowed to pass. The amount of time the moving door panels remain parallel is programmable. In T6, door 2 106 starts to rotate and move laterally thereby opening an exit for the subject 102 and by T7, door 2 106 has now completely opened allowing an individual 102 to exit. In T8 as door 2 106 has almost closed, door 1 104 is beginning to open to allow the next individual 108 to enter, and in T9 the next individual 108 is in the process of entering the access control device. The invention embodiment according to FIG. 1 requires that door 2 106 be closed or almost closed before door 1 104 can open to allow the next person to enter. This constraint reduces throughput to some degree relative to the next embodiment shown in FIG. 2.

It is noted that the term "perpendicular," as used throughout the various embodiments of this disclosure, is not necessarily limited to the precise geometrical perpendicularity of ninety degrees. Rather this term should be construed as substantially perpendicular with respect to the sidewalls and/or direction of traffic flow, so as to cause a closed position of the door panel(s) in order to block the passage of an individual or object through the security portal.

Figure 2:
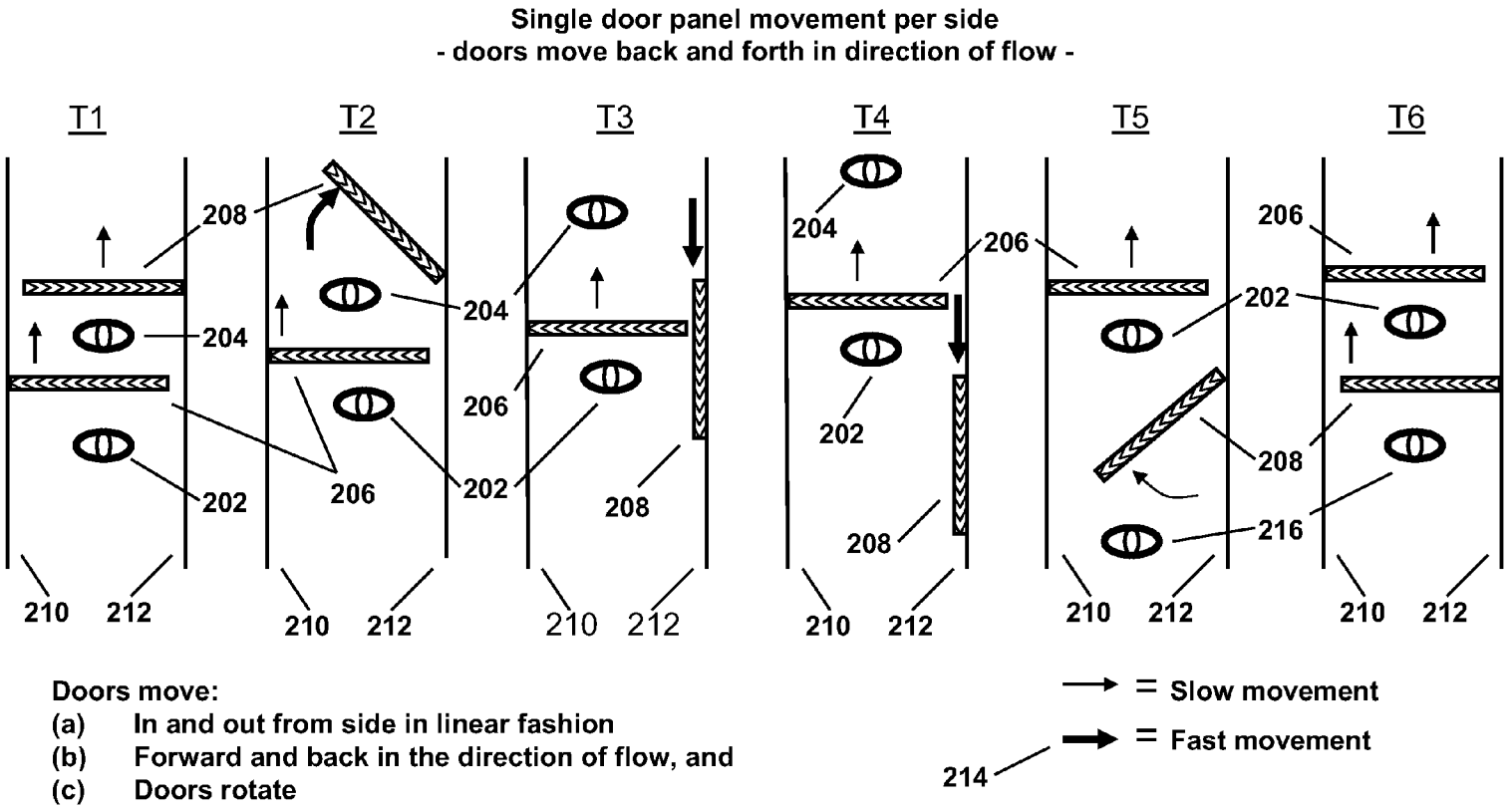
FIG. 2 is an illustration of the preferred embodiment of the security access control device functionality, in accordance with various embodiments of the invention.
Figure 3:
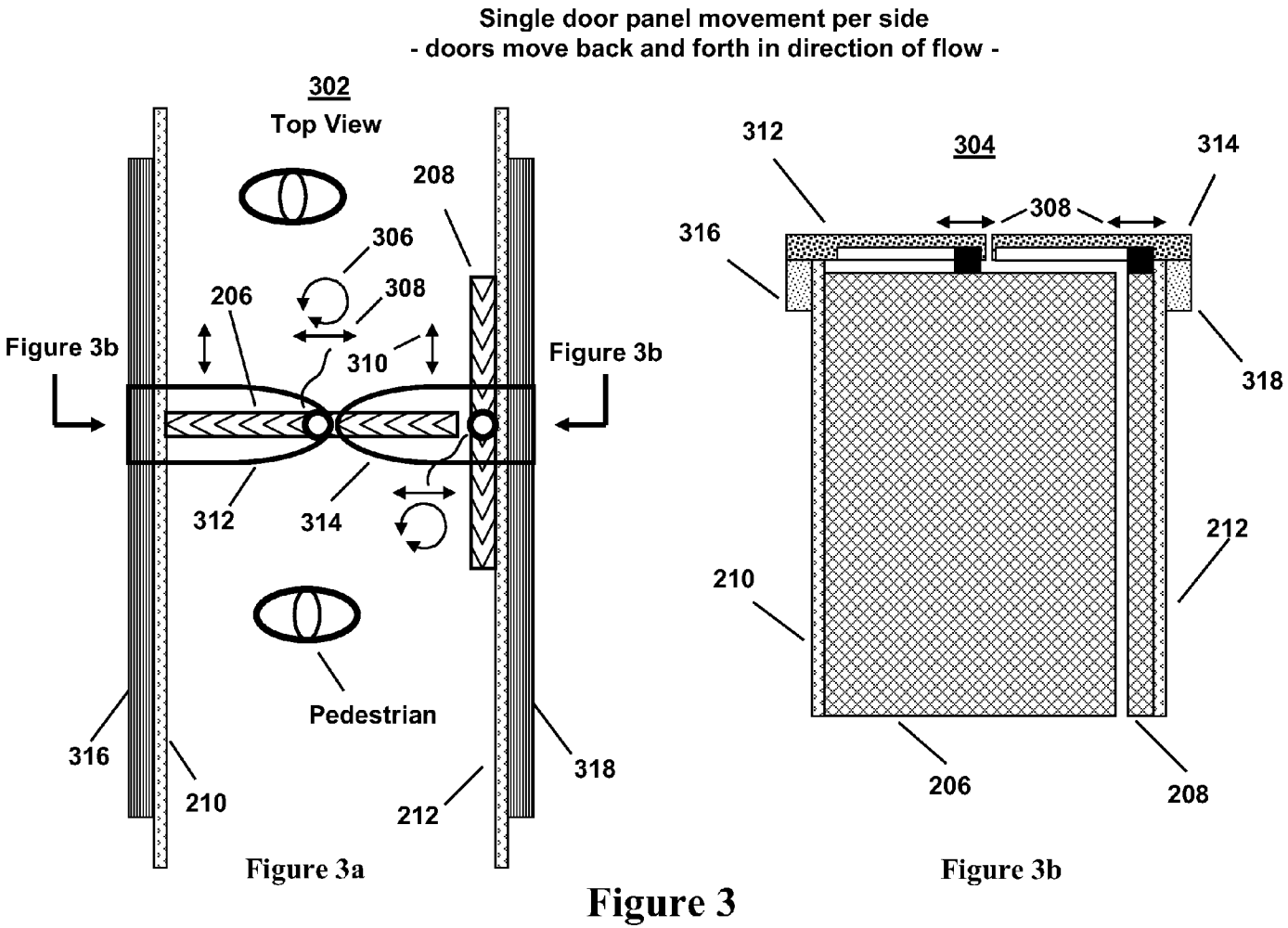
FIG. 3 is an illustration of the preferred embodiment of the security access control device, in accordance with various embodiments of the invention.

The preferred embodiment for the invention is shown in FIG. 2 and FIGS. 3*a* and 3*b*. FIG. 2 is shows the sequence of events whereby one individual 202 may be entering the access control device simultaneously with another individual 204 leaving the device, thereby enhancing throughput. In the embodiment shown in FIGS. 2, 3*a* and 3*b*, each door panel is electronically controlled to rotate 306 and move both laterally 308 and longitudinally 310 relative to the direction of flow. In timeframe T1 an individual 204 is within the access control device while another 202 is entering, and both door 1 206 and door 2 208 are instantaneously parallel to one another and preferably moving forward simultaneously, thus for that instant forming a detection chamber. When the moving door panels are parallel, they may move together in the direction of flow for a programmable amount of time to control the duration of time for which the detection chamber exists. In T2, door 2 208 is moving forward and rotating in a manner emulating a revolving door allowing the individual 204 within the access control device to begin to exit. Simultaneously in T2, door 1 206 is moving forward allowing the next individual 202 to enter. In T3, the individual 202 just entering continues to move forward behind door 1 206 while door 2 208 moves to become adjacent to the side panel 212 and then slides along the side panel 212 at a faster rate 214 until it is behind the person 202 currently entering as shown in T4. In T5, door 2 208 now begins to rotate and move laterally in a manner emulating a revolving door, eventually assuming a position behind the person 202 who has just entered as shown in T6 where the two moving door panels 206 and 208 are instantaneously parallel to one another and thus for that instant form a detection chamber. During T5 and T6, both door 1 206 and door 2 208 are also moving forward in the direction of flow, thus always allowing persons entering the access control device to be continually moving. Subsequent to timeframe T6, the sequence of T1 through T6 essentially repeats, however this time door 2 208 is in front of the person 216 about to enter the access control device and door 1 206 is in front of the person 202 who is currently within the access control device.

Note that at certain points in the sequence of operation, there appear to be gaps between a door panel and the side panel opposite that where that door panel's control arm attaches. To prevent these gaps being used by a perpetrator for passing weapons to another perpetrator, any gaps that exist between a door panel and a side panel at any point during the motion of the door panel may be optionally filled by additional sliding panels which move adjacent to a side panel in the vicinity of a door panel and are electro-mechanically controlled such that any gap that may emerge is filled, these additional sliding "filler panels" being controlled such that their motion does not interfere with the movement of any door panel.

FIGS. 3*a* and 3*b* show both a top view 302 and cross-section view 304 of an access control device according to the preferred embodiment of this invention. Each of the panels represented as door 1 206 and door 2 208 is suspended from control arms shown as arm 1 312 and arm 2 314. These control arms contain electromechanical mechanisms which cause the attached door panel to rotate 306, and also move the door panel attachment point laterally 308 relative to the direction of flow. In addition, each control arm is capable of moving longitudinally 310, the arm being driven by an electromechanical mechanism, thereby allowing the attached door panel to be moved longitudinally as the control arm it is suspended from moves longitudinally. The control arm moves longitudinally along a track 316/318 which is mounted at the top of the side panel 210/212.

Figure 4:
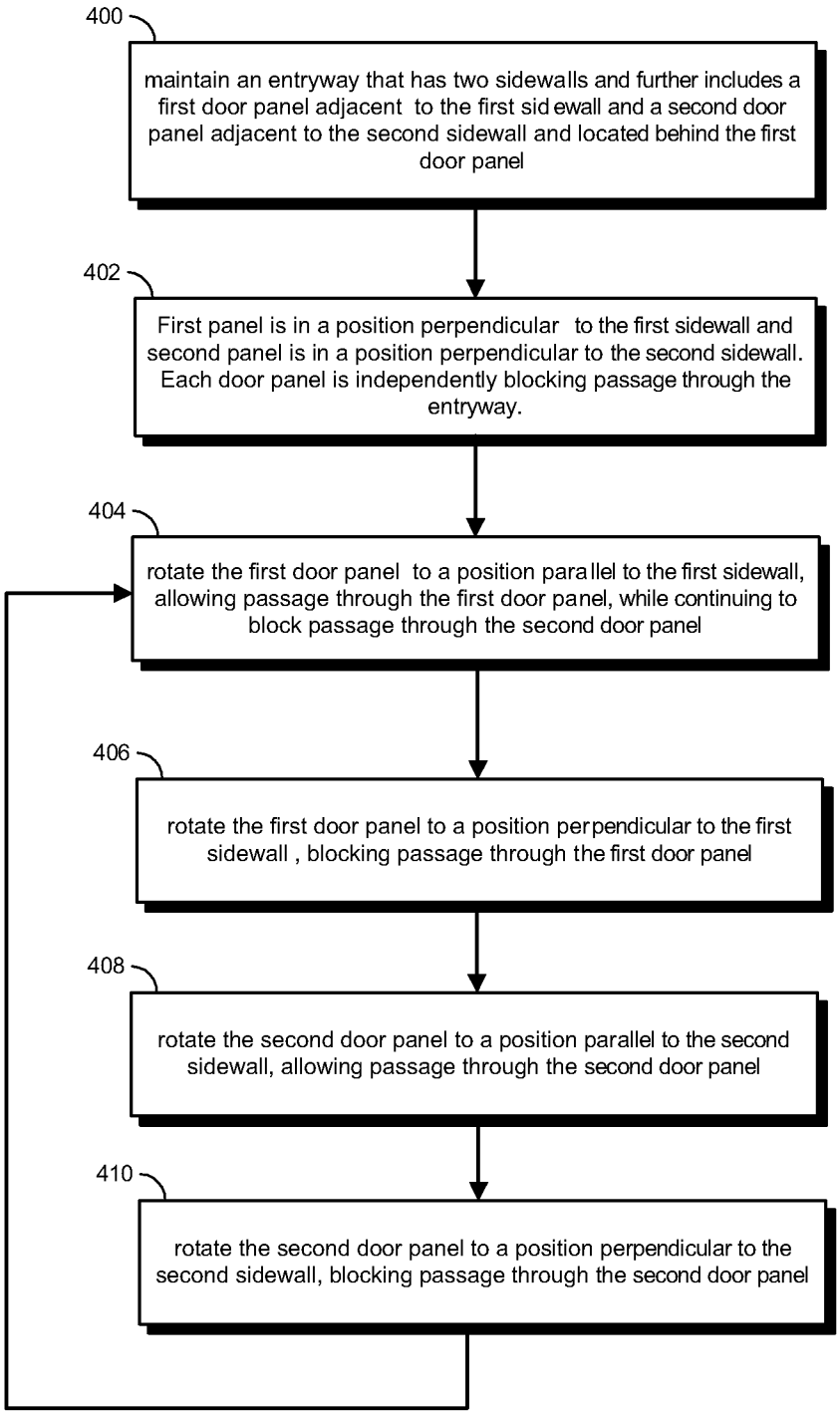
FIG. 4 is a flow chart diagram of the process for operating the security access control device, in accordance with the embodiment illustrated in FIG. 1.

FIG. 4 is a flow chart diagram of the process for operating the security access control device, in accordance with the embodiment illustrated in FIG. 1. Although this figure depicts functional steps in a particular sequence for purposes of illustration, the process is not necessarily limited to this particular order or steps. One skilled in the art will appreciate that the various steps portrayed in this figure can be changed, rearranged, performed in parallel or adapted in various ways. Furthermore, it is to be understood that certain steps or sequences of steps can be added to or omitted from this process, without departing from the spirit and scope of the invention.

As shown in step 400, the device can comprise an entryway can be deployed between two or more locations. This entryway can include two sidewalls with a first door panel adjacent to the first sidewall and a second door panel adjacent to the second sidewall. The second door panel is located behind the first door panel with respect to the direction of flow through the entryway.

Step 402 illustrates a possible starting position for the security access device. A shown in step 402, the first panel is in a position perpendicular to the first sidewall and the second panel is in a position perpendicular to the second sidewall. This effectively blocks passage through the entryway at each door panel. While both door panels are positioned perpendicular to the sidewalls and parallel to each other, a subject enclosed between the first and second panels may be scanned with one or more threat sensors to determine if they represent a threat. Should a threat be detected, the sequence of door panel movements may be subsequently altered to be different from that shown in FIG. 4 and may open the door behind the subject and allow them to exit the portal in reverse. It should be noted, however, that step 402 only shows the starting position for purposes of illustration, and that the device can actually start with the door panels being in any position shown throughout the figure.

In step 404, the first panel is rotated to a position parallel to the first sidewall, thereby allowing passage through the first door panel for an individual (or other subject). At the same time, the second door panel continues to be in the perpendicular position, blocking the remaining passage through the entryway.

Once the individual has passed the first panel, the first door panel rotates once again into the position perpendicular to the first sidewall, thereby effectively closing the chamber between the two panels (step 406). At this time, the subject can be scanned or otherwise inspected in the chamber.

In step 408, the second door panel then rotates to a position parallel to the first sidewall, allowing passage through the entryway for the individual. Once the individual passes through the opening, the second door panel can rotate back into the perpendicular (closed) position, as shown in step 410.

At this point in the flow chart, the process loops back to step 404, where the first door panel begins opening again to allow entrance to the next subject in line. In one embodiment, the first door panel can begin opening as soon as the second door panel has finished closing. In alternative embodiments, the first door panel can begin opening before the second door panel has finished closing, so long as the first panel is not completely open before the second panel has finished closing. With the embodiments described in FIGS. 1 and 4, it is generally undesirable to have both door panels open simultaneously (except in emergency situations, such as earthquakes or fires) due to the possibility of object/subject passing through the entryway.

Figure 5:
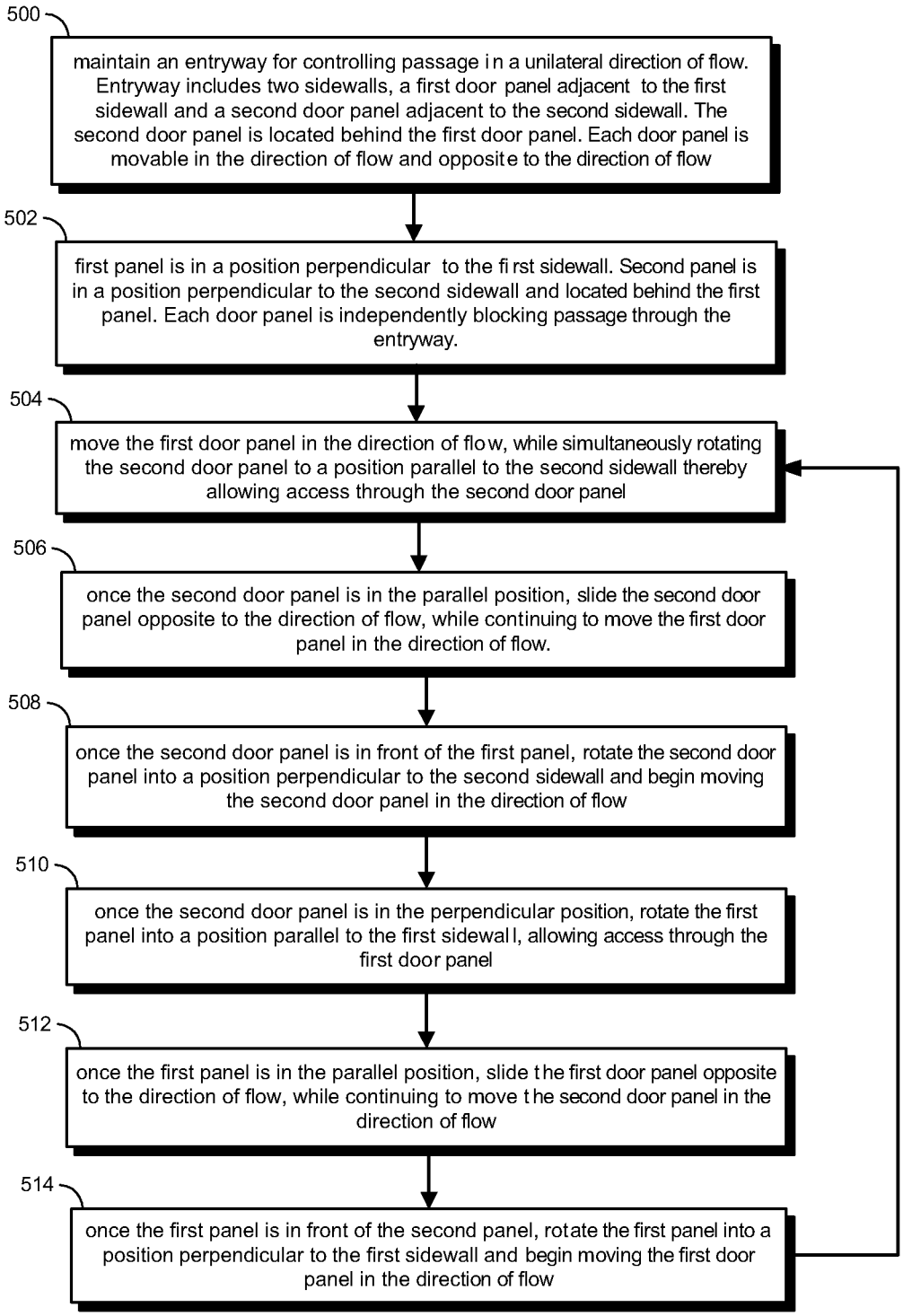
FIG. 5 is a flow chart diagram of the process for operating the security access control device, in accordance with the embodiment illustrated in FIG. 2.

FIG. 5 is a flow chart diagram of the process for operating the security access control device, in accordance with the embodiment illustrated in FIG. 2. Although this figure depicts functional steps in a particular sequence for purposes of illustration, the process is not necessarily limited to this particular order or steps. One skilled in the art will appreciate that the various steps portrayed in this figure can be changed, rearranged, performed in parallel or adapted in various ways. Furthermore, it is to be understood that certain steps or sequences of steps can be added to or omitted from this process, without departing from the spirit and scope of the invention.

As shown in step 500, the device includes two sidewalls, a first panel and a second panel, as previously described. In contrast to the embodiment shown in FIG. 1 with operational steps shown per FIG. 4, the embodiment of FIG. 2 and operational steps per FIG. 5 add a degree of freedom for the moving door panels. Whereas FIG. 1 and FIG. 4 describe door panels which may rotate 360° and move in a direction perpendicular to the direction of flow of subject movement, FIGS. 2 and 5 also allow the moving door panels to move independently in the direction of flow of subject movement. Moreover, for ease of understanding, the process illustration begins with both door panels in the closed position, as shown in step 502. While both moving door panels are positioned perpendicular to the sidewalls and parallel to each other as shown in step 502, a subject enclosed between the first and second moving door panels may be scanned with one or more threat sensors to determine if they represent a threat. Should a threat be detected, the sequence of door panel movements may be subsequently altered to be different from that shown in FIG. 5 and may open the door behind the subject and allow them to exit the portal in reverse.

In step 504, the first door panel is moved in the direction of flow, while the second door panel is simultaneously rotated into a position parallel to the sidewall, allowing passage through the second door. Once the second panel is in the open position, it begins to slide in the direction opposite from the direction of flow until it passes the first door panel (step 506). At this point, the second door panel is now in front of the first door panel.

In step 508, once the second door panel is in front of the first, it rotates into a closed position (perpendicular to the sidewalls). At this point, the second door panel begins to move in the direction of flow, while being maintained in the closed position.

After the second panel has been closed and is moving along the direction of flow, the first panel is rotated into an open (parallel) position, allowing passage therethrough, as shown in step 510.

In step 512, the first panel is slid opposite to the direction of flow until it passes the second panel. In the meanwhile, the second door panel continues to move in the direction of flow.

In step 514, once the first panel is in front of the second panel, it is rotated back into the closed position and begins to move once again in the direction of flow. At this point, the process can loop back to step 504, where the second panel is rotated to the open position.

The processes shown in FIGS. 4 and 5 can continue indefinitely, or can be stopped and (re)started automatically or as needed. It should also be noted that the unidirectional traffic flow through the entryway can be reversed, as will be clearly evident to one of ordinary skill in the art in light of this disclosure.

Figure 6:
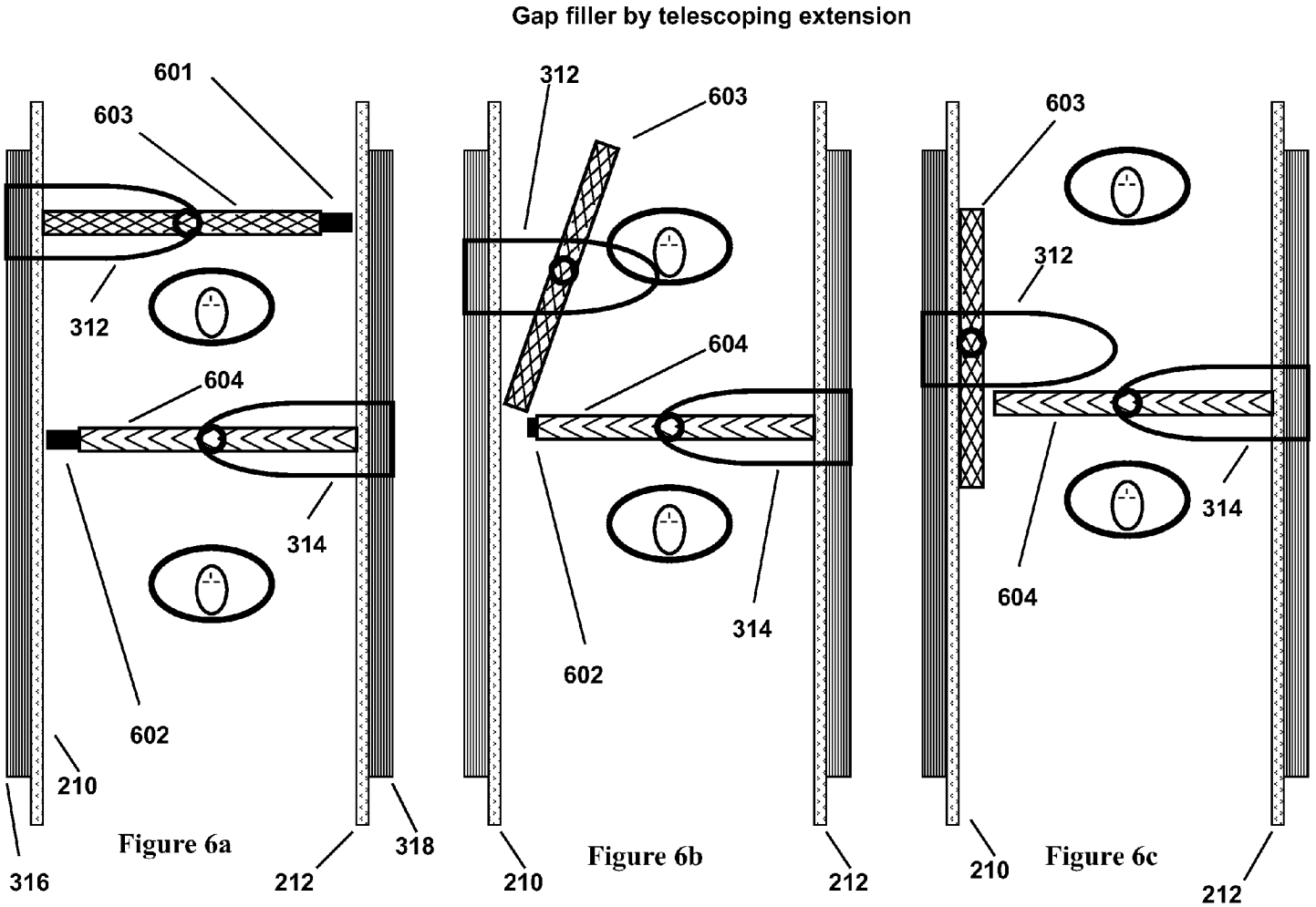
FIG. 6 is an illustration of the means for filling the gap between a moving door panel and a sidewall.
Figure 7:
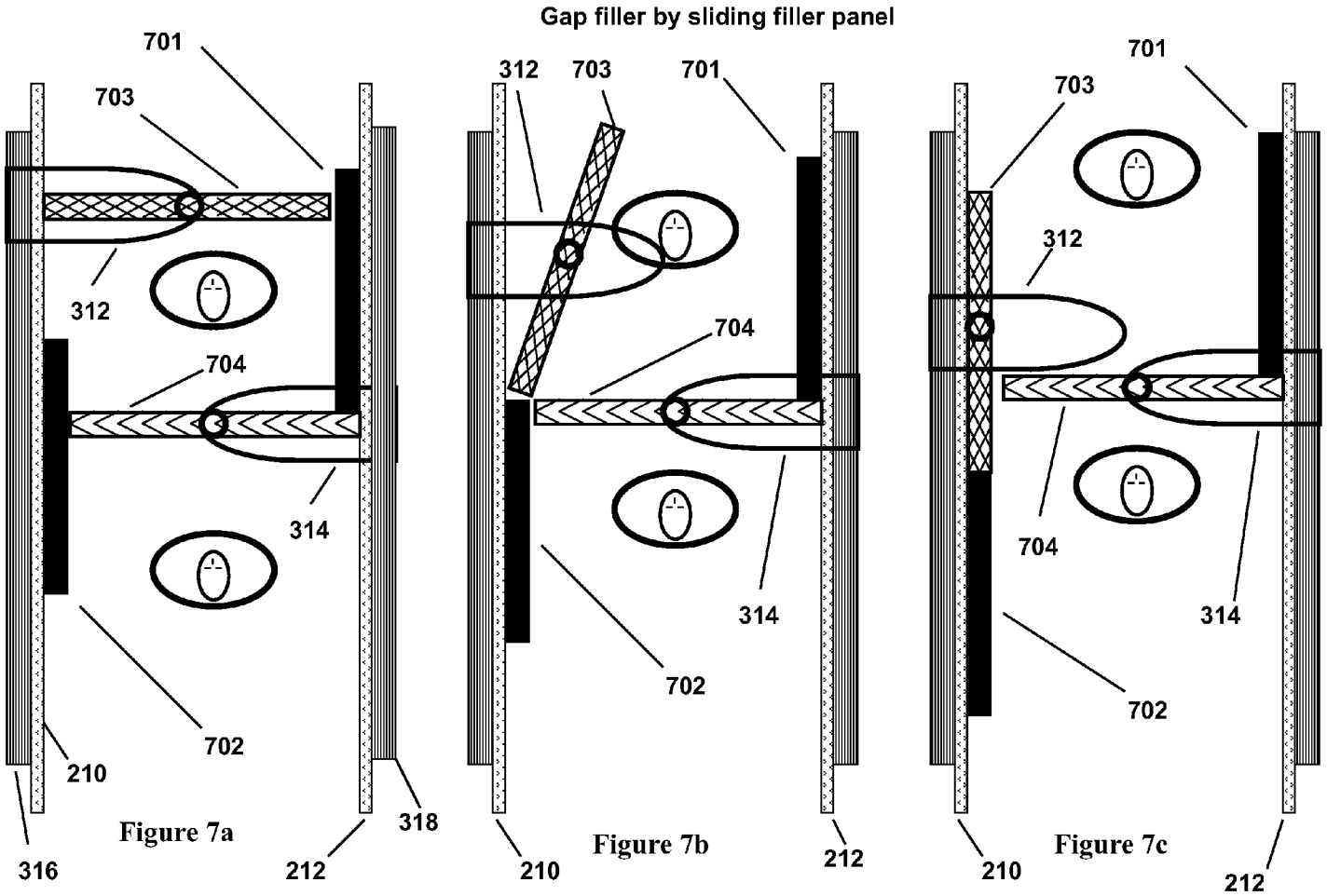
FIG. 7 is an illustration of alternative means for filling the gap between a moving door panel and a sidewall.

As mentioned earlier, it is highly preferable that there not be a moment in time where a gap exists that would allow passage of even a small weapon (for instance a small gun or grenade) through the portal. As shown in FIGS. 6 and 7 it is desirable to have means for filling the gap between a moving door panel and a sidewall. Thus, the scenario may be prevented where two or more subjects work together such that a first subject who does not carry a weapon may pass through the portal first, and subsequently a second subject might toss a weapon through the gap in the portal to the first subject who is already on the inside of the facility being protected by the portal. For the embodiment of FIG. 2 where each moving door panel must occasionally pass alongside the other moving door panel during operation of the portal, there must be a gap available for this passage to occur. As shown in FIG. 6*a*, this gap is filled by telescoping extensions 601 and 602 that project from door panels 603 and 604 respectively under control of the portal's control system. In FIG. 6*b*, as door panel 603 moves closer to a position parallel with the sidewall, telescoping extension 602 starts to withdraw into door panel 604 to create a gap for panel 603 to pass. In FIG. 6*c*, door panel 603 is now parallel and adjacent to the sidewall and is passing alongside door panel 604, telescoping extension 602 having now been completely withdrawn into door panel 604.

A similar scenario exists in FIG. 7 where sliding filler panels 701 and 702 performing similar tasks to the telescoping extensions of FIG. 6. In FIG. 7*a*, sliding filler panels 701 and 702 fill the gaps adjacent to door panels 703 and 704 respectively. In FIG. 7*b*, door panel 703 is moving towards the sidewall and starting to pass through the gap adjacent to door panel 704, while sliding filler panel 702 is beginning to withdraw from the gap which door panel 703 will shortly occupy.

In FIG. 7*c*, door panel 703 is now fully adjacent to the sidewall and is in the gap adjacent to door panel 704, filler panel 702 having withdrawn to allow the passage of door panel 703. At another point in the sequence of operation, sliding filler panel 701 performs a similar function to filler panel 702, moving aside to allow door panel 702 to pass through a gap between door panel 703 and the opposite sidewall.

Figure 8:
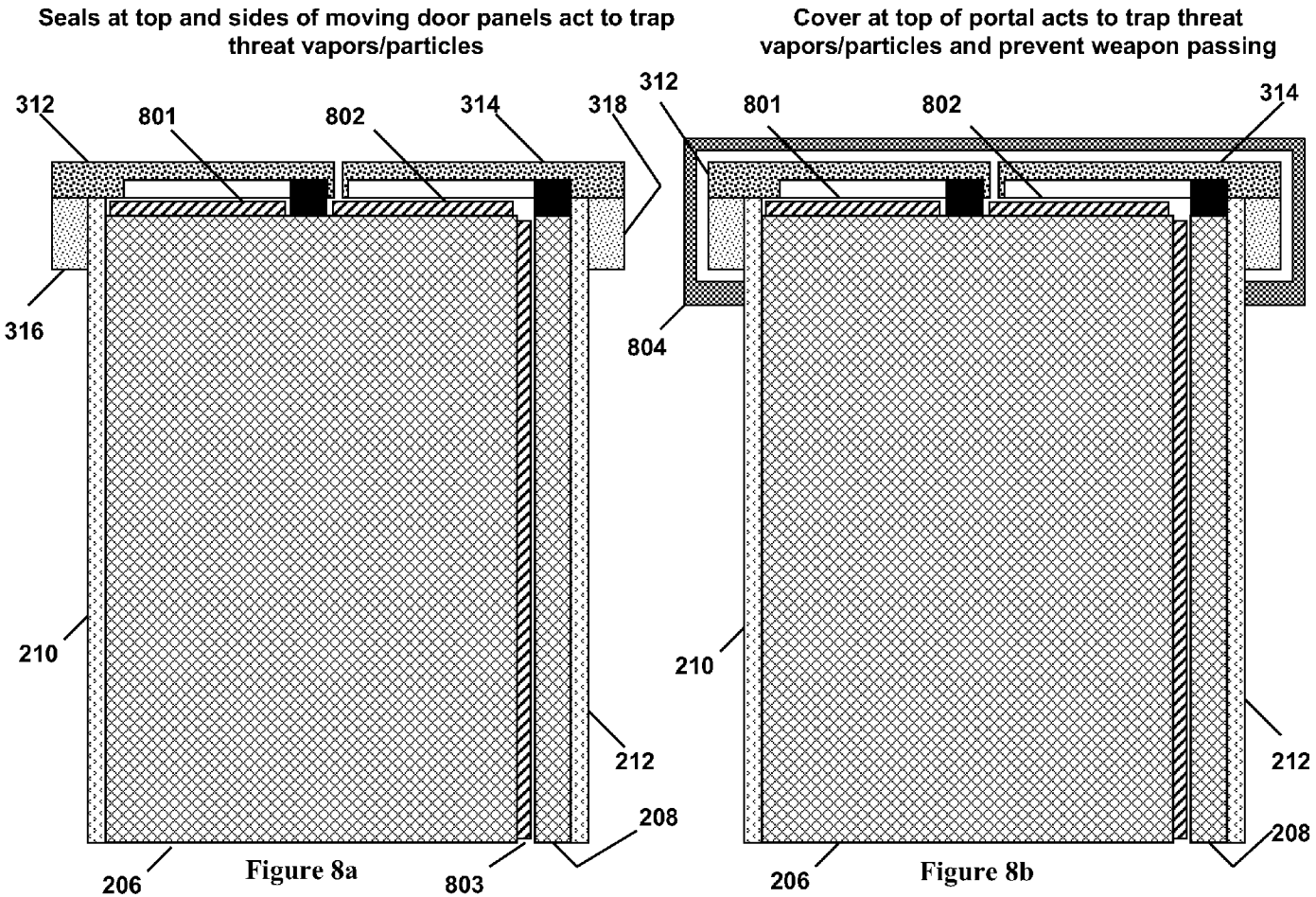
FIG. 8 is an illustration of the seals that may be attached to the top of a moving door panel or to the side of a moving door panel.

It may be desirable to include chemical sensors within the portal for the detection of explosive devices, CWAs (chemical warfare agents), or bio-pathogens being carried by a subject passing through the portal. It may also be desirable to include sensors to detect chemical vapors emitted by a subject that may be useful as part of a biometric sensing strategy to determine the subject's state of mind. For any of these vapor sensing applications, it is useful to have the detection chamber defined by the two moving door panels and the two side walls be sealed to the movement of air for that brief moment when the moving door panels are fully parallel to one another. During that brief moment, such sealing of the detection chamber may allow a forced movement or "puff" of air to mobilize some particles that may be clinging to the subject or the subjects clothing or emanating from the subject or an explosive device, and move any suspect particles or vapors into one or more threat detection devices. Such threat detection devices may include without limitation MS, MS-MS, IMS, GC, GCMS, SAW array sensors, or various forms of polymer coated sensing devices including microcantilevers and capacitive or resistive sensing devices. As shown in FIG. 8*a*, seals 801 and 802 may be attached to the top of a moving door panel while seal 803 may be attached to the side of a moving door panel (or to the edge of a telescoping gap filler device such as 602). To create an effective seal at the top of the portal, top cover 804 is included as shown in FIG. 8*b*, this cover running for the length of the portal. The presence of cover 804 also prevents a weapon from being tossed over the portal.

Figures 9A, 9B:
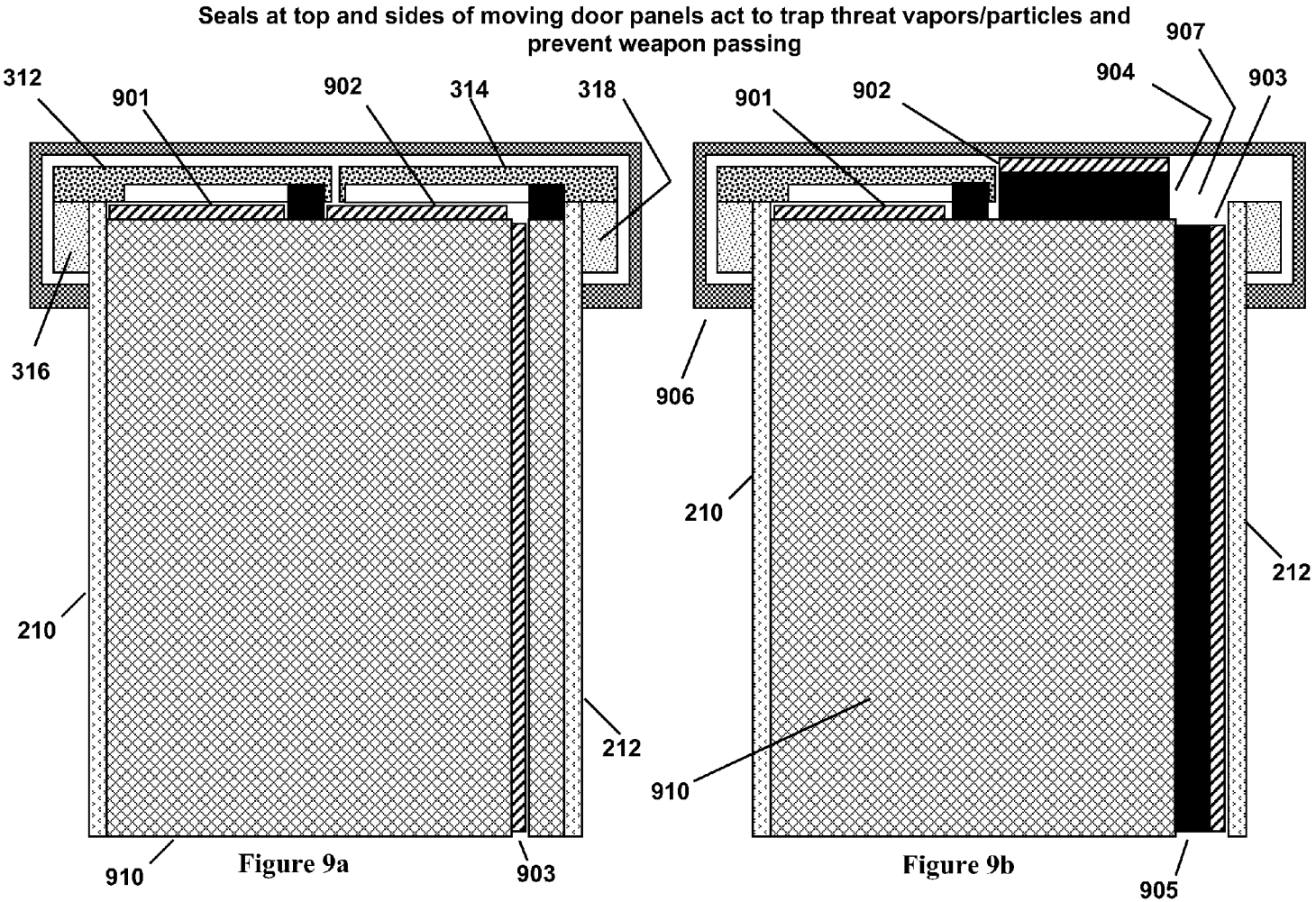
FIGS. 9*a*-9*c* are illustrations of further possibilities for temporarily sealing the detection chamber formed when the moving door panels are parallel to each other.
Figure 9C:
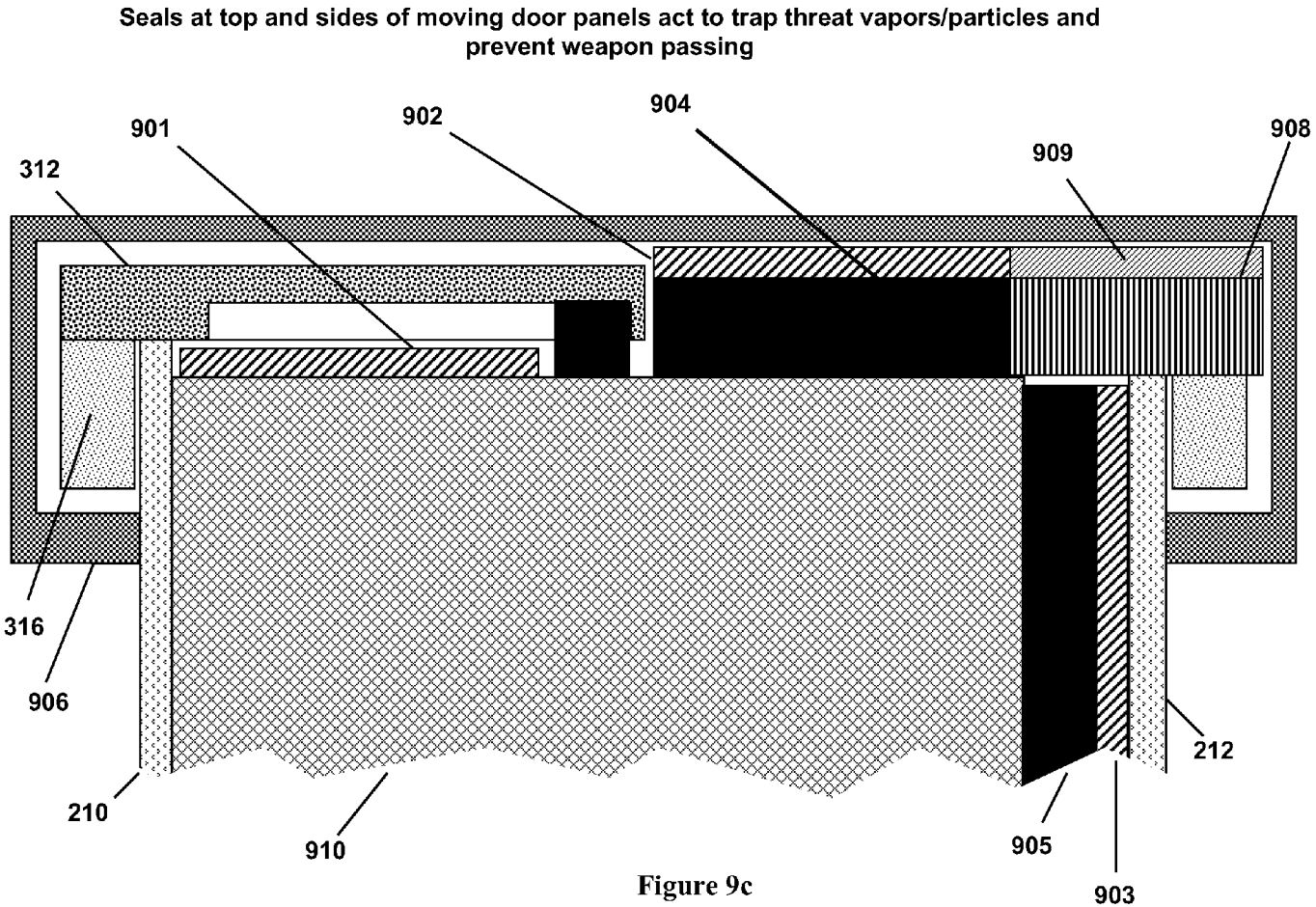

FIG. 9 shows further possibilities for temporarily sealing the detection chamber formed when the moving door panels 910 are parallel to each other. In FIG. 9*a*, seals 901, 902 and 903 appear similar to seals 801, 802 and 803 of FIG. 8. However, as shown in FIG. 9*b*, gap filler extension 904 is attached to seal 902 in order to allow seal 902 to be raised and contact top cover 906 when the moving door panels are parallel to one another. Additionally, seal 903 is attached to telescoping gap filler extension 905 in order to form a seal with the sidewall.

Notice that in FIG. 9B, there is still a gap 907 in the upper right-hand corner of the detection chamber which is not sealed by gap filler extensions 904 and 905. One solution to this problem is described in FIG. 9*c*. One embodiment for filling gap 907 when the moving door panels are parallel or near parallel is accomplished by gap filler extension 908 that telescopes sideways and emerges from gap filler extension 904. Attached to gap filler extension 908 is seal 909 that is normally stored within seal 902 and emerges from within seal 902 in a sideways telescoping manner when gap filler extension 908 also moves sideways. The amount of sideways movement of extension 908 and seal 909 can be controlled according to the angle of moving door panel 910 so that gap 907 is filled even when door panel 910 is not parallel to the other door panel and perpendicular to the sidewall. This enables extension 908 and seal 909 to prevent passing of a weapon through gap 907 both before and after a detection chamber is formed between the door panels and the sealing to limit air movement becomes critical for CBE detection (Chemical, Explosive, and Bio).

Figure 10:
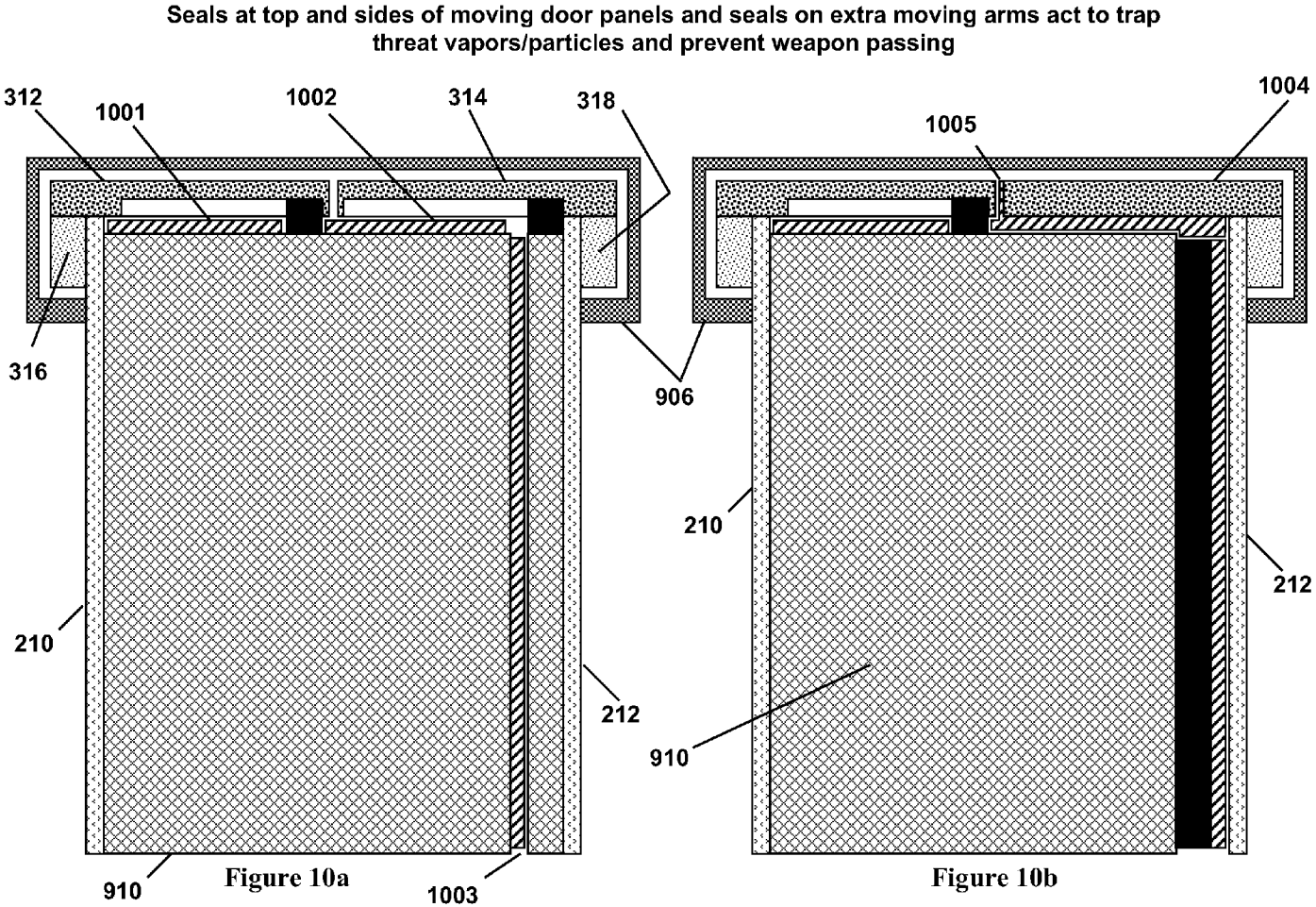
FIG. 10 is an illustration of another solution for filling a gap between a door panel and a top cover.

Another solution for filling gap 907 is shown in FIG. 10. FIG. 10*a* shows the point in time where the two moving door panels are perpendicular to each other, and seals 101, 102 and 103 are effective because of the alignment of the door panels. However, the point in time corresponding to FIG. 10*a* is not when the detection chamber is formed. FIG. 10*b* shows the point time when the two door panels are parallel to one another and gap 907 in the upper right-hand corner of FIG. 9*b* would be formed were object 1004 not available to fill this gap. Object 1004 is an extra moving arm similar to the arms that support the moving door panels, except that object 1004 has no moving door panel attached, instead having seal 1005 attached to it. Therefore when the two moving door panels are parallel, and extra moving arm such as 104 will slide into position over each moving door panel thereby filling gap 907.

Figure 11:
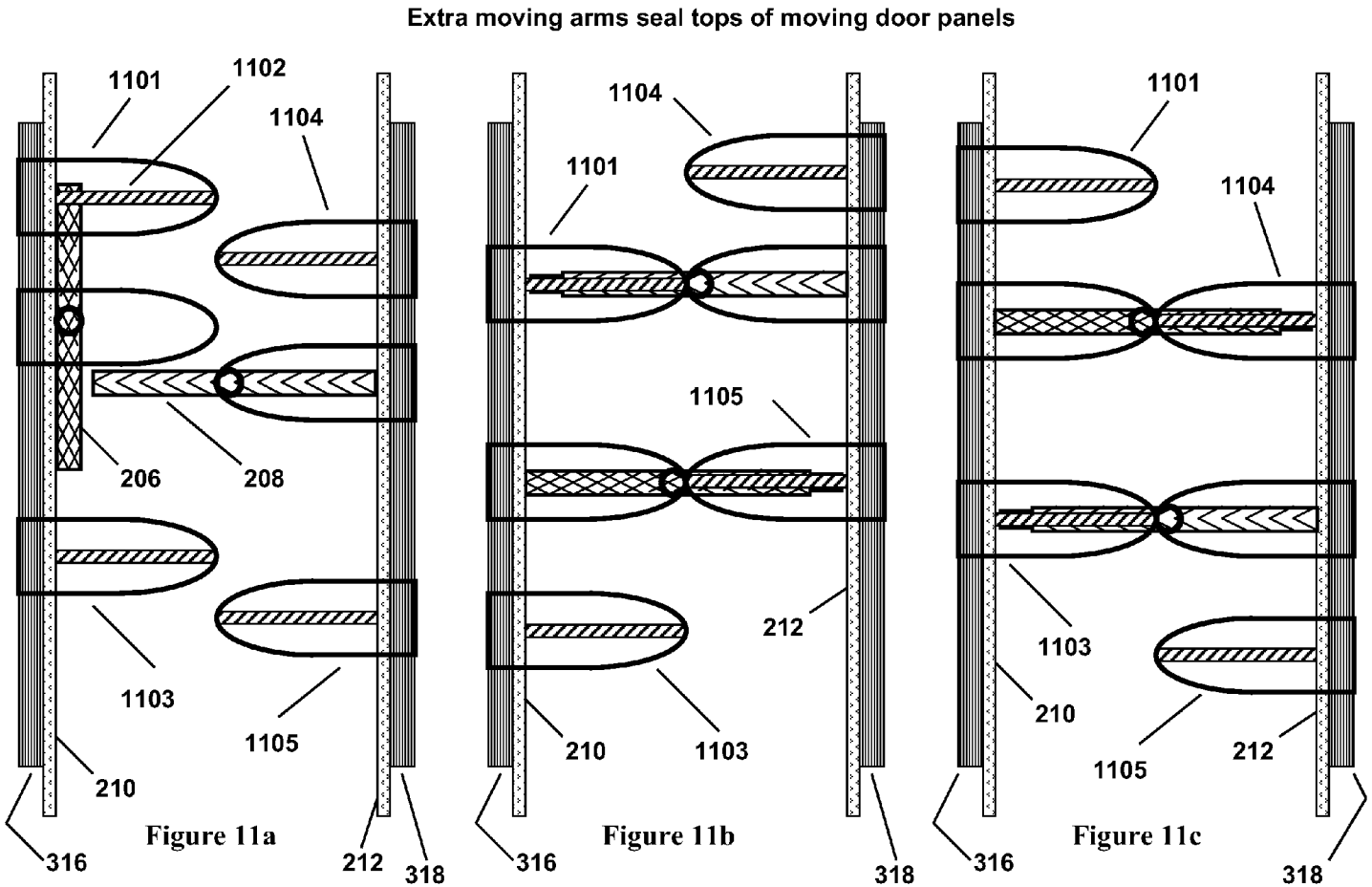
FIG. 11 is an illustration of a top view of the access control device or portal where extra moving arms are included that may slide into position to fill gaps at the top corners of the detection chamber formed when the moving door panels are parallel to each other.

FIG. 11 shows a top view of the access control device or portal according to this invention where extra moving arms are included that may slide into position to fill gaps at the top corners of the detection chamber formed when the moving door panels are parallel to each other. FIG. 11*a* shows extra moving arms of 1101, 1103, 1104, and 1105, none of which are attached to moving door panels, and all of which contain a seal such as seal 1102 attached to extra moving arm 1101. In the scenario of FIG. 11*a*, the moving door panels are not parallel to each other and thus none of the extra moving arms are positioned to complete a seal of the detection chamber. In the scenario of FIG. 11*b*, the moving door panels are positioned parallel to each other and thus extra moving arm 1101 is positioned to complete a seal above one of the moving door panels while extra moving arm 1105 is positioned to complete a seal above the other moving door panel, thus completing sealing of the detection chamber. Extra moving arms 1103 and 1104 are not utilized in the scenario of FIG. 11*b*. In FIG. 11*c*, the moving door panels are also parallel to one another forming a detection chamber, but their relative positions are reversed. Thus in FIG. 11*c*, extra moving arms 1103 and 1104 are positioned to perform seals above the moving door panels while extra moving arms 1101 and 1105 are not utilized.

Figure 12:
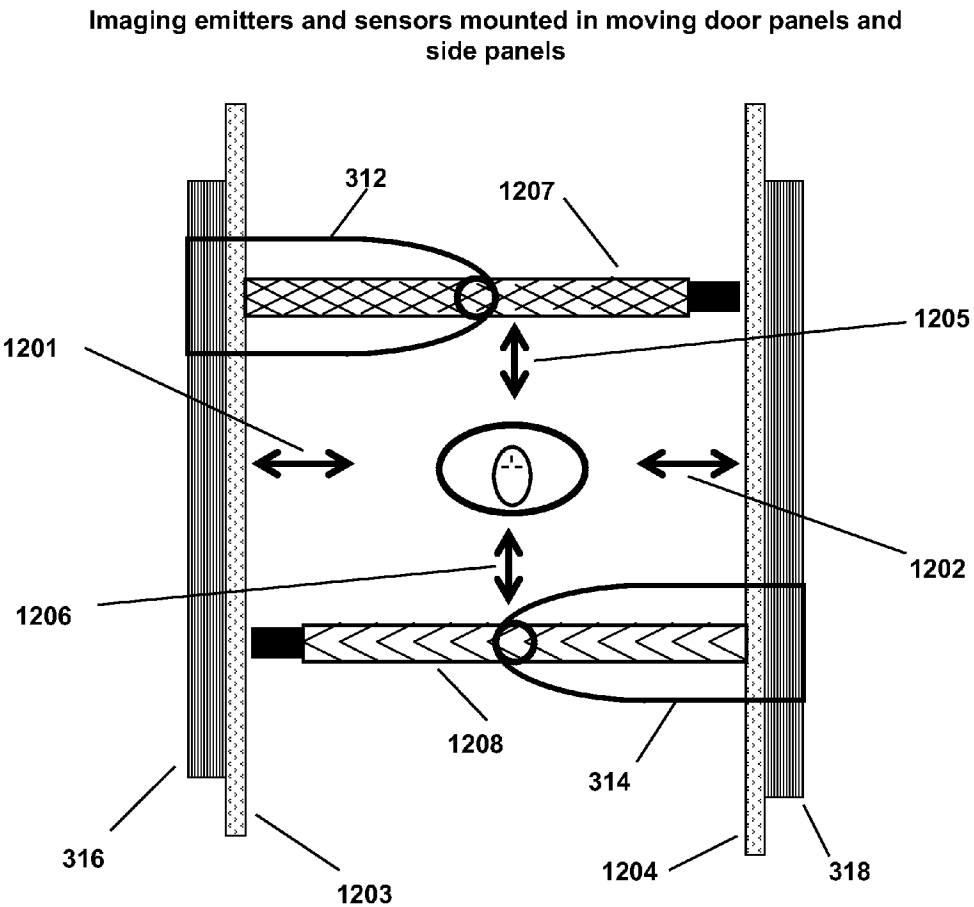
FIG. 12 is an illustration of imaging sensors and emitters mounted in moving door panels and side panels.

As shown in FIG. 12, when moving door panels 1207 and 1208 are parallel, a detection chamber is formed with side walls 1203 and 1204 forming the other two walls of the chamber. In addition to conventional metal detection technologies, and various chemical, explosive, and Bio-detection technologies, there are imaging technologies which may be employed to observe the subject, the subject's clothing, and objects that the subject may be carrying whether concealed or visible. Various RF imaging technologies exist such as UWB radar, that enable a view of the subject that penetrates any clothing to reveal shapes that may correspond to the shape of various weapons. Emitters and/or detectors for these RF imaging technologies may be located in both the moving door panels and the side panels, and the paths of RF radiation within the detection chamber may be represented by arrows 1201 and 1202 when emitters and/or detectors are mounted in the side walls, and by arrows 1205 and 1206 when emitters and/or detectors are mounted in the moving door panels. Note that the moving door panels may be continuously rotated 360° in either direction, and that depending upon their position in the operational sequence when a detection chamber is created, either side of a moving door panel may in fact be facing the detection chamber. Thus, any imaging emitters and/or detectors mounted on a moving door panel should be mounted redundantly on both sides of the door panel.

Similarly, video cameras for optical imaging of a subject may be mounted both sides of the moving door panels and optionally on the side walls as well. Video imaging may be included such that a subject's face may be observed as they walk through the access control device. Observing and analyzing the expressions on a subject's face have been shown to offer clues as to a subject's state of mind—especially when they are contemplating a violent act and/or self-destruction. To ensure that the subject's face is properly viewed such that the image can be properly analyzed by computer, the system can prompt a subject—by voice or signage or both—to look straight ahead for consistent and proper video capture. When thus prompted, if the subject does not comply, the system may optionally stop allowing forward progress of the subject until they comply, or alternately may deny passage and back them out of the portal.

As a further aid to monitoring the position of a subject passing through the portal and further to ensure the number of subjects within the portal, position detection may also be performed by mounting emitters and/or sensors in either the floor or top cover of the portal or both. These positions sensors may be of IR, sonic, or some other technology.

Figure 13:
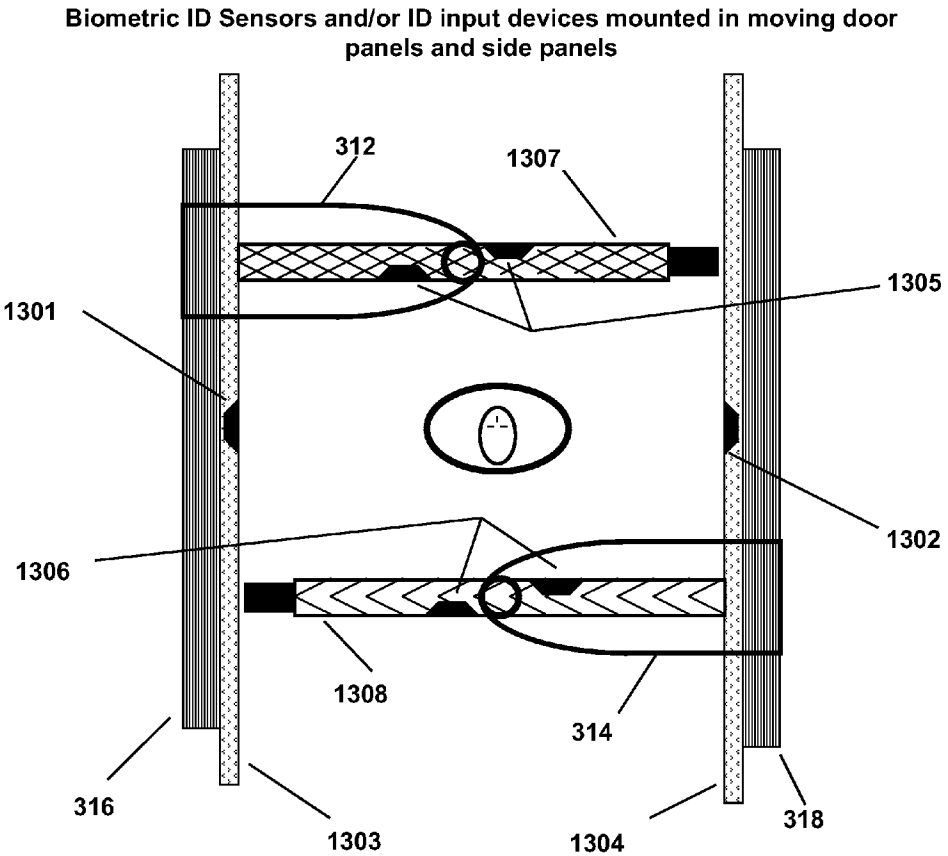
FIG. 13 is an illustration of biometric ID sensors and/or ID input devices mounted in moving door panels and side panels.

At times, it may be useful to identify a subject who is within the detection chamber of an access control device according to this invention. This circumstance may occur if a security guard wishes to pass through the portal and is carrying a weapon. As shown in FIG. 13, to allow this person to pass, the operational sequence of the portal may pause at the point where the moving door panels 1307 and 1308 are parallel forming a detection chamber. The subject may then interact with a biometric detection device such as 1305 and 1306 located in a moving door panel, or 1301 and 1302 located in sidewalls 1303 and 1304 respectively. A common way to perform this biometric validation would be a fingerprint identification mechanism. Alternately, or in combination, a device capable of performing a retinal scan may also be included. Thus, if the system confirms that there is only one person in the detection chamber and that person is positively identified as being allowed to pass while caring a weapon, the sequence of operation of the portal will continue and allow the person to enter the secured area. Another circumstance where biometric specification is useful is to identify disabled persons that may need to pass through the portal along with various metallic devices such as a wheelchair, crutches, or cane. Again, if this person is certified to be safe to pass and the detection mechanisms in the detection chamber within the portal determine that only this person is present and they are validated, then the operation of the portal may proceed further and allow them to pass. Yet another circumstance may arise where a security guard may assist a disabled person or child in passing through the portal. Again, the security guard can identify themselves to the biometric sensing system and be allowed to pass along with the person they are escorting.

Figure 14:
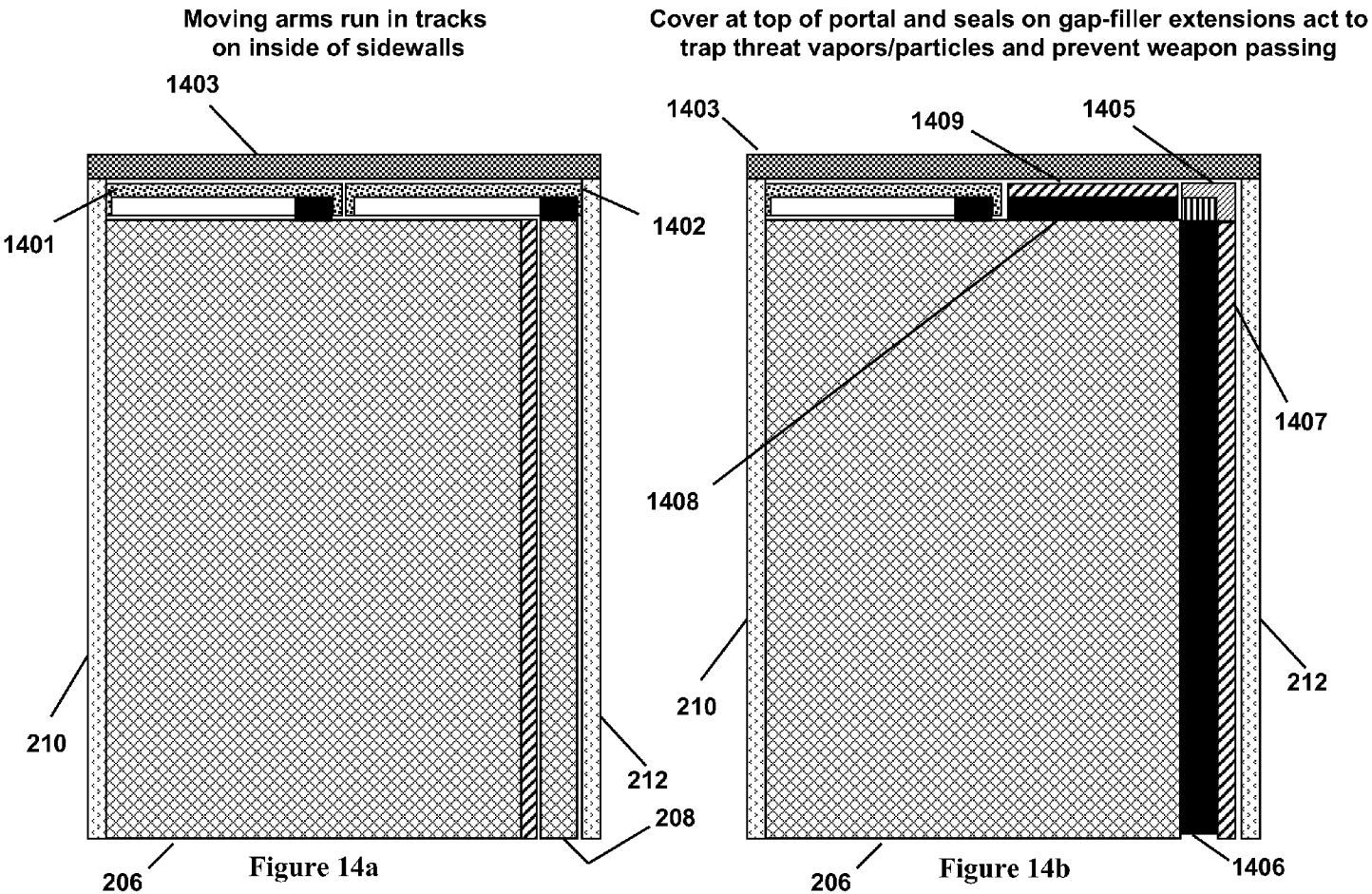
FIG. 14 is an illustration of an embodiment of the portal where moving arms are attached to tracks on the inside of the sidewalls as opposed to the top or outside of the sidewalls.

FIG. 14*a* shows cross sections of an embodiment of the portal where moving arms 1401 and 1402 are attached to tracks on the inside of the sidewalls as opposed to the top or outside of the sidewalls as shown in previous figures. This allows the top cover 1403 of the portal to be lowered somewhat, and reduces the amount of space/gap such as gap 907 in FIG. 9*b* to be filled in order to seal the detection chamber and/or thwart weapon passing over the moving door panels. In FIG. 14*b*, this gap is filled by corner gap filler panel and seal 1405 which may be moved into position by telescoping vertically from within horizontal telescoping extension 1406 attached to seal 1407. Alternately, gap filler panel 1405 could be implemented to telescope horizontally from extension 1408 attached to seal 1409.

Figure 15:
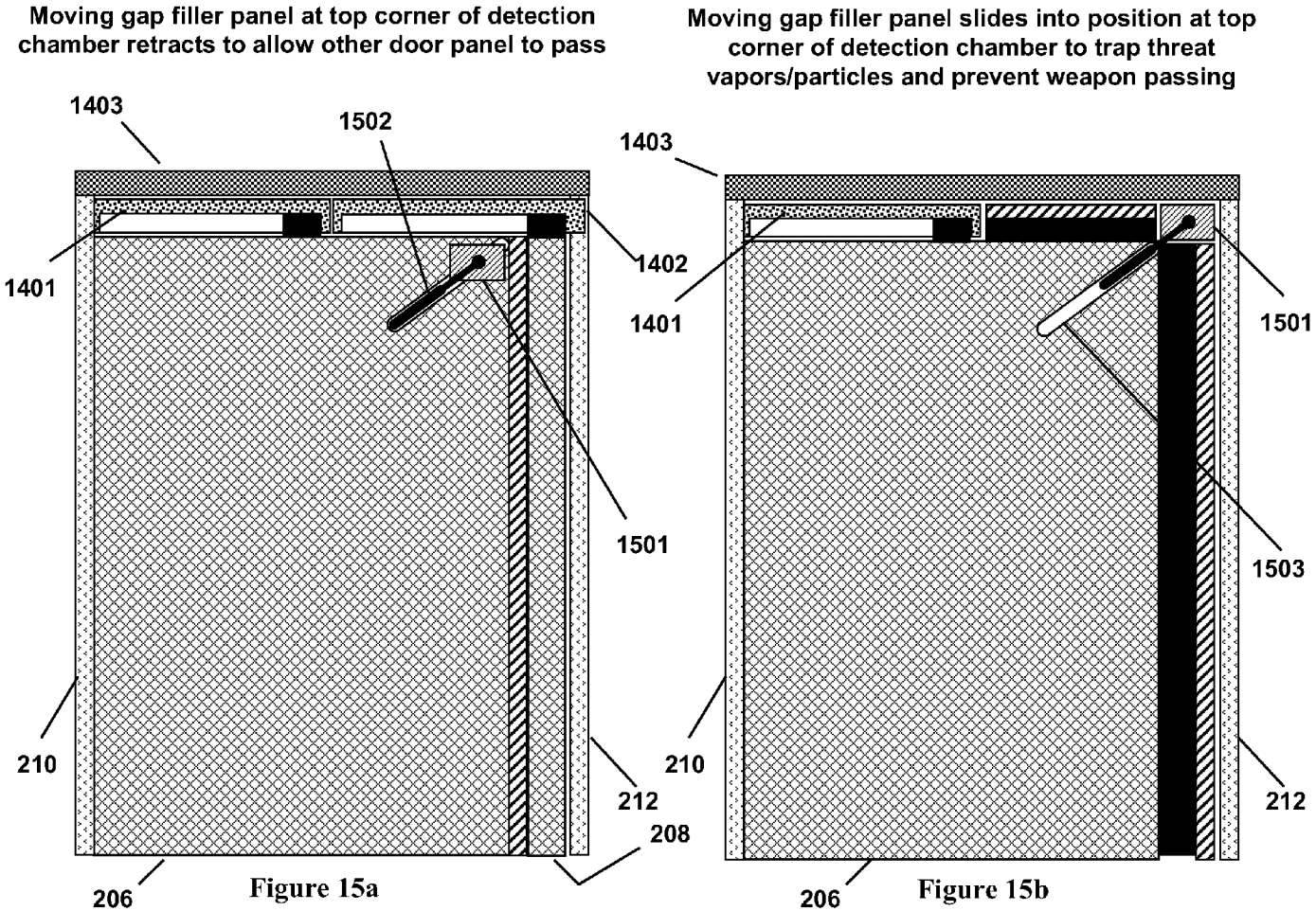
FIG. 15 is an illustration of a gap filler panel that may slide diagonally into position when needed.

To simplify the deployment of a filler panel for gap 907 or the gap filled by gap filler panel 1405, a filler panel may be implemented as shown in FIG. 15 where gap filler panel 1501 slides diagonally into position when needed (when the moving door panels are essentially parallel to each other or whenever gap 907 might allow a weapon to be passed over a moving door panel). FIG. 15*a* shows gap filler panel 1501 and arm 1502 attached to it in a retracted position. In FIG. 15*b*, gap filler panel 1501 and arm 1502 slide diagonally, with arm 1502 sliding in channel 1503, until filler panel 1501 arrives fully in position in gap 907 to effect a full seal of the detection chamber formed when the two moving door panels are essentially parallel.

The various embodiments described throughout this specification also include the software and object code used to control the access control device according to various embodiments of this invention. These embodiments include a computer program product which is a storage medium (media) having instructions stored thereon/in, which can be used to program a general purpose or specialized computing processor(s)/device(s) to perform any of the features presented herein. As a non-limiting illustration, the instructions stored on the computer readable storage medium can cause a processor to rotate and move the panels of the security door in a particular sequence/manner. Similarly, the instructions can cause the processor to start, stop and resume the rotation of the door according to signals received from a set of sensors embedded in the security door. Additionally, the instructions can cause the processor to reverse the sequence of movement of the door panels after a suspected threat is detected such that the subject is compelled to back out of the access control device, or optionally be restrained within the access control device.

The storage medium can include, but is not limited to, one or more of the following: any type of physical media including floppy disks, optical discs, DVDs, CD-ROMs, microdrives, magneto-optical disks, holographic storage, ROMs, RAMs, PRAMS, EPROMs, EEPROMs, DRAMs, VRAMs, flash memory devices, magnetic or optical cards, nanosystems (including molecular memory ICs); paper or paper-based media; and any type of media or device suitable for storing instructions and/or information.

Stored one or more of the computer readable medium (media), the present disclosure includes software for controlling both the hardware of general purpose/specialized computer(s) and/or processor(s), and for enabling the computer(s) and/or processor(s) to interact with a human user or other mechanism utilizing the results of the present invention. Such software may include, but is not limited to, device drivers, operating systems, execution environments/containers, user interfaces and applications.

The foregoing description of the preferred embodiments of the present invention has been provided for purposes of illustration and description. It is not intended to be exhaustive or to limit the invention to the precise forms disclosed. Many modifications and variations can be apparent to the practitioner skilled in the art. Embodiments were chosen and described in order to best explain the principles of the invention and its practical application, thereby enabling others skilled in the relevant art to understand the invention. It is intended that the scope of the invention be defined by the following claims and their equivalents.

The invention claimed is:

1. A device for securely controlling passage between two or more locations, comprising:

an entryway that controls said passage in a unidirectional traffic flow, said traffic flow being unidirectional at any particular moment in time, said entryway having a first sidewall and a second sidewall, wherein the first and second sidewalls are each linear and are parallel to one another;

first and second moveable and rotatable door panels positioned between the linear portions of the first and second sidewalls; and wherein each door panel is linearly moveable in a direction of said traffic flow while being positioned perpendicular with respect to the first and second sidewalls, wherein after moving in the direction of traffic flow each door panel reaches a first point along said entryway and rotates into a position parallel to and moves adjacent one of the first and second sidewalls, wherein upon having rotated and moved, each door panel moves in a direction opposite to said traffic flow until said panel reaches a second point along said entryway;

wherein upon having reached the second point, each door panel moves away from the one of the first and second sidewalls and rotates into a position perpendicular with respect to the first and second sidewalls and is again linearly moveable in the direction of said traffic flow while being positioned perpendicular with respect to the first and second sidewalls; and wherein at a first point in time the first and second door panels are parallel to one another and at a second point in time the first and second door panels are perpendicular to one another.

2. The device of claim 1, wherein the first panel and the second panel are configured to move simultaneously, such that at the second point in time the first panel is moving in the direction of said traffic flow while the second panel is moving in the direction opposite to said traffic flow.

3. The device of claim 1, further comprising:

a first mechanized arm that controls a movement of said first panel, the first mechanized arm capable of moving along the direction of said traffic flow and opposite to said traffic flow; and a second mechanized arm that controls the movement of said second panel, the second mechanized arm capable of moving along the direction of said traffic flow and opposite to said traffic flow.

4. The device of claim 3, wherein each mechanized arm further includes:

an attachment point to one of the first and second panels, wherein the attachment point is capable of applying rotation to said panel and wherein the attachment point is further capable of moving along the mechanized arm laterally in a direction that is perpendicular to the sidewalls.

5. The device of claim 1, wherein the first panel further includes:

a filler component that fills a gap between the first panel and the second sidewall of said entryway when the first panel is positioned perpendicular to said first sidewall of the entryway.

6. The device of claim 1, wherein passage is blocked through said entryway when the first panel is perpendicular to the first sidewall.

7. The device of claim 1, wherein the unidirectional traffic flow is electronically reversible.

8. The device of claim 1, further comprising:

one or more sensors that detect crowd motion, wherein the unidirectional traffic flow is reversed in response to signals received from the sensors.

9. The device of claim 1, further comprising:

at least one sensor selected from a group consisting of: a metal detector, a chemical sensor, a biological sensor, a radiological sensor, an X-ray imaging system, and a radio frequency (RF) imaging system.

10. An apparatus for securely controlling passage in a unidirectional traffic flow, said apparatus comprising:

an entryway that allows the passage in a direction of said traffic flow, said entryway including two linear sidewalls, wherein the two linear sidewalls are parallel to one another;

two door panels, each door panel being rotatable between a position perpendicular to said sidewalls and a position parallel to said sidewalls;

wherein each of said two door panels is independently movable in the direction of said traffic flow while simultaneously being fixed in the position perpendicular to said sidewalls; and wherein each of said two door panels is independently movable in a direction opposite said traffic flow while simultaneously being fixed in the position parallel to said sidewalls.

11. The apparatus of claim 10, further comprising:

a top cover situated over the two sidewalls, wherein the top cover blocks objects from being thrown over said two door panels.

12. The apparatus of claim 11, further comprising:

mechanized arms that control rotation and movement of the two door panels; and a gap filler extension situated between each door panel and the top cover.

13. The apparatus of claim 11, further comprising:

two mechanized arms that control rotation and movement of the two door panels;

at least two additional mechanized arms that are unattached to any of said door panel; and wherein each additional mechanized arm acts to fill a gap between one of the door panels and the top cover.

14. The apparatus of claim 12, wherein the gap filler extension further includes a sideways telescoping extension.

15. The apparatus of claim 12, further comprising:

a seal that is situated between each of the two door panels and the mechanized arm that controls said each of the two door panels.

16. The apparatus of claim 10, further comprising:

one or more filler panels attached to each door panel, wherein said filler panels extend out of said each door panel to block passage between the door panel and one of the sidewalls when the door panel is in the position perpendicular to the sidewalls.

17. The apparatus of claim 10, further comprising:

one or more sliding filler panels positioned parallel to and adjacent each of the two sidewalls, wherein the sliding filler panels block passage between a door panel and one of the sidewalls when the door panel is in the position perpendicular to the sidewalls.

18. The apparatus of claim 10, further comprising:

one or more sensors embedded in one or more of the door panels or one or more of the sidewalls, wherein said one or more sensors include at least one of the following:

an imaging sensor, an imaging emitter, a biometrical identification sensor, and a biometrical input device.

19. An apparatus for securely controlling passage through two linear sidewalls that are arranged parallel to one another, said apparatus comprising:

two door panels located between the sidewalls where each door panel is independently moveable and rotatable via a mechanical connection at a top of the door panel;

wherein each door panel is controlled robotically to be independently rotatable about a substantially vertical axis;

wherein each door panel is controlled robotically to be independently moveable in a direction toward one of the two linear sidewalls; and wherein each door panel is linearly moveable along the linear sidewalls in a first direction while positioned perpendicular with respect to the sidewalls; and wherein each door panel is linearly moveable along the linear sidewalls in a second direction opposite the first direction while positioned parallel with respect to the sidewalls.

20. The apparatus of claim 19 wherein for each door panel, the mechanical connection connects with a movable structure above the door panel, and wherein the movable structure is robotically moveable in a longitudinal direction that is parallel with respect to the sidewalls.

21. The apparatus of claim 20 wherein for each door panel, the mechanical connection is robotically moveable with respect to the movable structure in the direction toward either of the two linear sidewalls.

* * * * *

UNITED STATES PATENT AND TRADEMARK OFFICE

CERTIFICATE OF CORRECTION

PATENT NO. : 8,499,494 B2
APPLICATION NO. : 12/502997
DATED : August 6, 2013
INVENTOR(S) : Robert Osann, Jr.

It is certified that error appears in the above-identified patent and that said Letters Patent is hereby corrected as shown below:

On the Title Page:

Item (12), delete "Robert, Jr." and insert --Osann, Jr.--.

Item (76), delete "Osann Robert, Jr." and insert --Robert Osann, Jr.--.

Signed and Sealed this
Seventeenth Day of September, 2013

Teresa Stanek Rea

Teresa Stanek Rea
*Deputy Director of theUnited States Patent and Trademark Office*